US007380647B2

(12) United States Patent
Liang

(10) Patent No.: US 7,380,647 B2
(45) Date of Patent: Jun. 3, 2008

(54) LUGGAGE

(76) Inventor: Joseph Liang, No. 30, Hsing-Tien Rd., Lin 11, Hsin-Nan Tsun, Kao-Shu Hsiang, Ping-Tung Hsien (TW)

( * ) Notice: Subject to any disclaimer, the term of this patent is extended or adjusted under 35 U.S.C. 154(b) by 789 days.

(21) Appl. No.: 10/919,074

(22) Filed: Aug. 16, 2004

(65) Prior Publication Data

US 2006/0032718 A1 Feb. 16, 2006

(51) Int. Cl.
*A45C 13/26* (2006.01)

(52) U.S. Cl. ..... 190/115; 16/113.1

(58) Field of Classification Search ..... 190/115; 16/113.1, 116.1

See application file for complete search history.

(56) References Cited

U.S. PATENT DOCUMENTS 4,256,320 A * 3/1981 Hager ..... 280/37
6,409,207 B1 * 6/2002 Kuo ..... 280/655.1

* cited by examiner

*Primary Examiner*—Tri M Mai
(74) *Attorney, Agent, or Firm*—Frommer Lawrence & Haug LLP; Ronald R. Santucci

(57) ABSTRACT

A luggage includes a case body provided with a guiding rail, a slider mounted slidably on the guiding rail, a coupling unit pivoted to the slider, a handle rod connected to the coupling unit, an abutting member having a protrusion and pivoted to the slider for movement between a first angular position, in which the protrusion is free of contact with the guiding rail, and a second angular position, in which the protrusion abuts against the guiding rail when the slider is disposed at a predetermined position and when the handle rod is disposed at an inclined position.

8 Claims, 13 Drawing Sheets

LUGGAGE

BACKGROUND OF THE INVENTION

1. Field of the Invention

This invention relates to a luggage, more particularly to a luggage having a handle unit with an abutting member that abuts against a case body of the luggage for preventing damage to a retaining unit.

2. Description of the Related Art

FIGS. 1 and 2 illustrate a conventional wheeled luggage 2 that includes a case body 20 formed with a pair of handle-storing tubes 22, and a handle unit 21 including a pair of handle rods 25. Each of the handle rods 25 is pivoted to a corresponding slider 23 that is slidably disposed in a respective one of the handle-storing tubes 22 so as to permit retraction of the handle rods 25 into the handle-storing tubes 22, respectively, when the handle rods 25 are disposed in a non-inclined position relative to the handle-storing tubes 22, and so as to permit pivoting movement of the handle rods 25 relative to the handle-storing tubes 22 when the handle rods 25 are fully extended from the handle-storing tubes 22. A retaining unit includes a pair of engaging parts 261 disposed movably and respectively in the handle rods 25 and engaging respectively and releasably engaging grooves 232 that are formed in one end 231 of the sliders 23 in the handle-storing tubes 22 so as to retain the handle unit 21 at a desired inclined position relative to the case body 20. The conventional luggage 2 can be moved in a pulling manner or a pushing manner using the handle unit 21.

The conventional luggage 2 is disadvantageous in that the retaining unit tends to get damaged when the case body 20 is fully loaded and is moved in the pushing manner using the handle unit 21. In addition, since the engaging grooves 232 in the ends 231 of the sliders 23 are normally shallow, the engaging parts 261 tend to disengage from the engaging grooves 232 during the pushing operation of the case body 20.

SUMMARY OF THE INVENTION

Therefore, the object of the present invention is to provide a luggage with an abutting member that is connected to the handle unit of the luggage and that is capable of overcoming the aforementioned drawbacks of the prior art.

According to the present invention, there is provided a luggage that comprises: a case body; a handle-storing unit including at least a guiding rail that is secured to the case body, and that has opposite front and rear end portions and a bottom wall which is formed with a through-hole defined by a hole-defining wall and disposed adjacent to the front end portion of the guiding rail, the hole-defining wall having an abutting face; a slider mounted slidably on the guiding rail, and slidable on the guiding rail between a first position, in which the slider is disposed adjacent to the rear end portion of the guiding rail, and a second position, in which the slider is disposed adjacent to the front end portion of the guiding rail; a coupling unit pivoted to the slider; a handle unit including at least an elongated handle rod that is coupled to the slider through the coupling unit and that is pivotable relative to the slider when the slider is disposed at the second position; an abutting member pivoted to the slider, having an abutting protrusion that protrudes therefrom, and driven by the handle rod through the coupling unit to pivot relative to the slider from a first angular position to a second angular position when the handle rod is pivoted relative to the slider from a non-inclined position to an inclined position relative to the guiding rail, the abutting protrusion being disposed outwardly of the through-hole when the abutting member is disposed at the first angular position and when the slider is disposed at the second position, and extending into the through-hole and being disposed frontwardly of and abutting against the abutting face of the hole-defining wall when the abutting member is disposed at the second angular position and when the slider is disposed at the second position; and a retaining unit for retaining the handle rod at a desired angle relative to the guiding rail when the slider is disposed at the second position.

BRIEF DESCRIPTION OF THE DRAWINGS

In drawings which illustrate an embodiment of the invention.

DETAILED DESCRIPTION OF THE PREFERRED EMBODIMENT

FIGS. 3 to 7 illustrate the preferred embodiment of a wheeled luggage according to this invention. The wheeled luggage includes a case body 31 and a handle assembly mounted on the case body 31.

Figure 9:
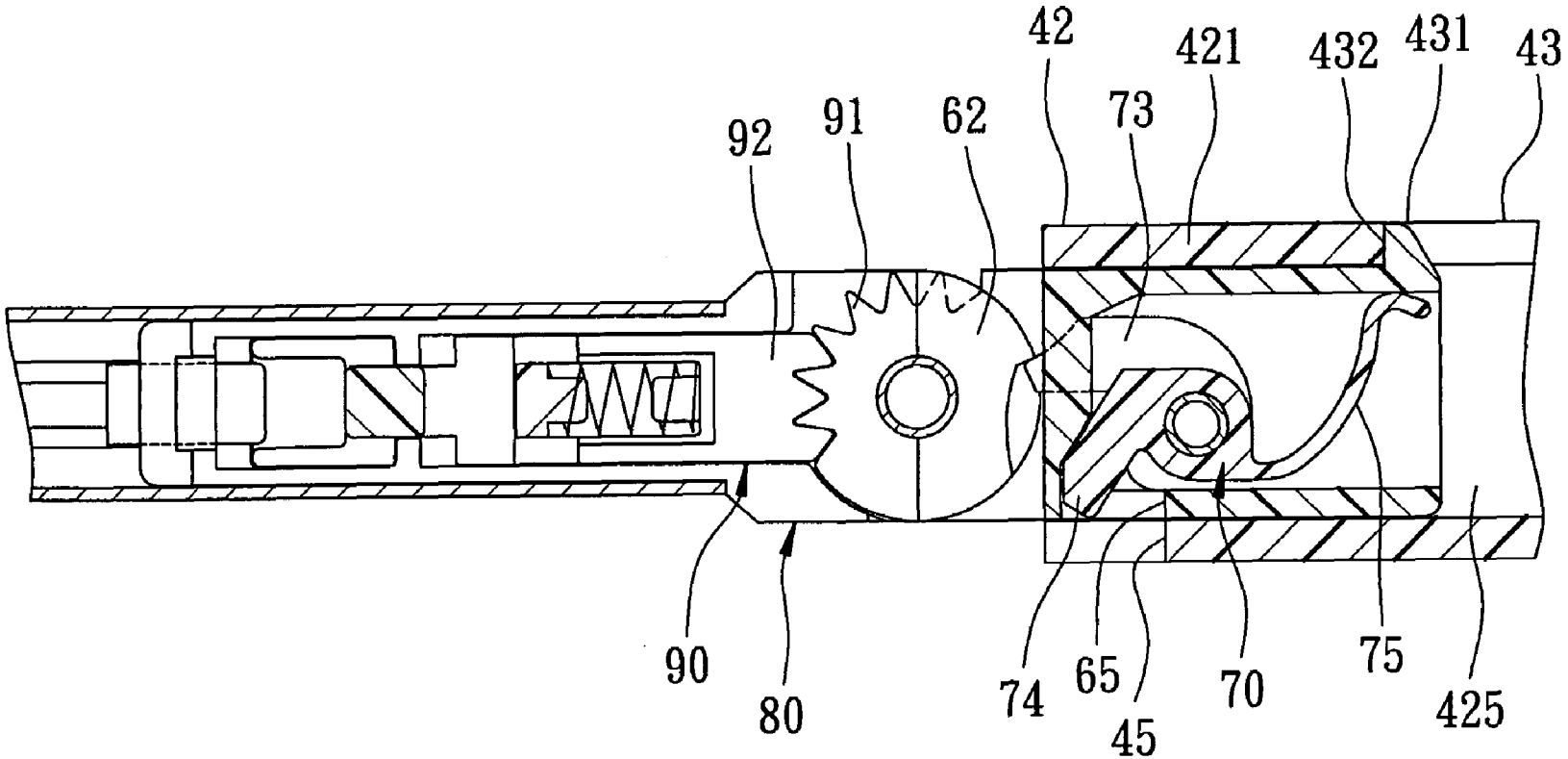
FIG. 9 is a fragmentary side sectional view to illustrate the preferred embodiment in a state where the slider is disposed at a second position, where the abutting member is disposed at the first angular position, and where the handle rod is disposed at the non-inclined position.

The handle assembly includes: a handle-storing unit 40 including a pair of parallel guiding rails 42, each of which is secured to the case body 31 and each of which has opposite front and rear end portions 421, 422 and a bottom wall 424 which is formed with a through-hole 45 (see FIGS. 9 and 10) defined by a hole-defining wall and disposed adjacent to the front end portion 421 of the respective guiding rail 42, the hole-defining wall having an abutting face 451; a pair of sliders 60, each of which is mounted slidably on a respective one of the guiding rails 42, and each of which is slidable on the respective guiding rail 42 between a first position (see FIGS. 5, 6 and 7), in which the slider 60 is disposed adjacent to the rear end portion 422 of the respective guiding rail 42, and a second position (see FIG. 9), in which the slider 60 is disposed adjacent to the front end portion 421 of the respective guiding rail 42; a pair of coupling units 80, each of which is pivoted to a respective one of the sliders 60; a handle unit 50 including a grip part 56 and a pair of elongated handle rods 51, each of which is coupled to a respective one of the sliders 60 through a respective one of the coupling units 80 and each of which is pivotable relative to the respective slider 60 when the respective slider 60 is disposed at the second position (see FIGS. 9 to 12); a pair of abutting members 70, each of which is pivoted to a respective one of the sliders 60, each of which has an abutting protrusion 74 that protrudes therefrom, and each of which is driven by a respective one of the handle rods 51 through a respective one of the coupling units 80 to pivot relative to the respective slider 60 from a first angular position (see FIG. 9) to a second angular position (see FIG. 10) when the handle rods 51 are pivoted relative to the sliders 60 from a non-inclined position (see FIG. 9) to an inclined position (see FIG. 10) relative to the guiding rails 42, the abutting protrusion 74 being disposed outwardly of the through-hole 45 when the respective abutting member 70 is disposed at the first angular position and when the sliders 60 are disposed at the second position (see FIG. 9), and extending into the through-hole 45 and being disposed frontwardly of and abutting against the abutting face 451 of the hole-defining wall when the respective abutting member 70 is disposed at the second angular position and when the sliders 60 are disposed at the second position (see FIG. 10); and a retaining unit 90 for retaining the handle rods 51 at a desired angle relative to the guiding rails 42 when the sliders 60 are disposed at the second position.

Figure 10:
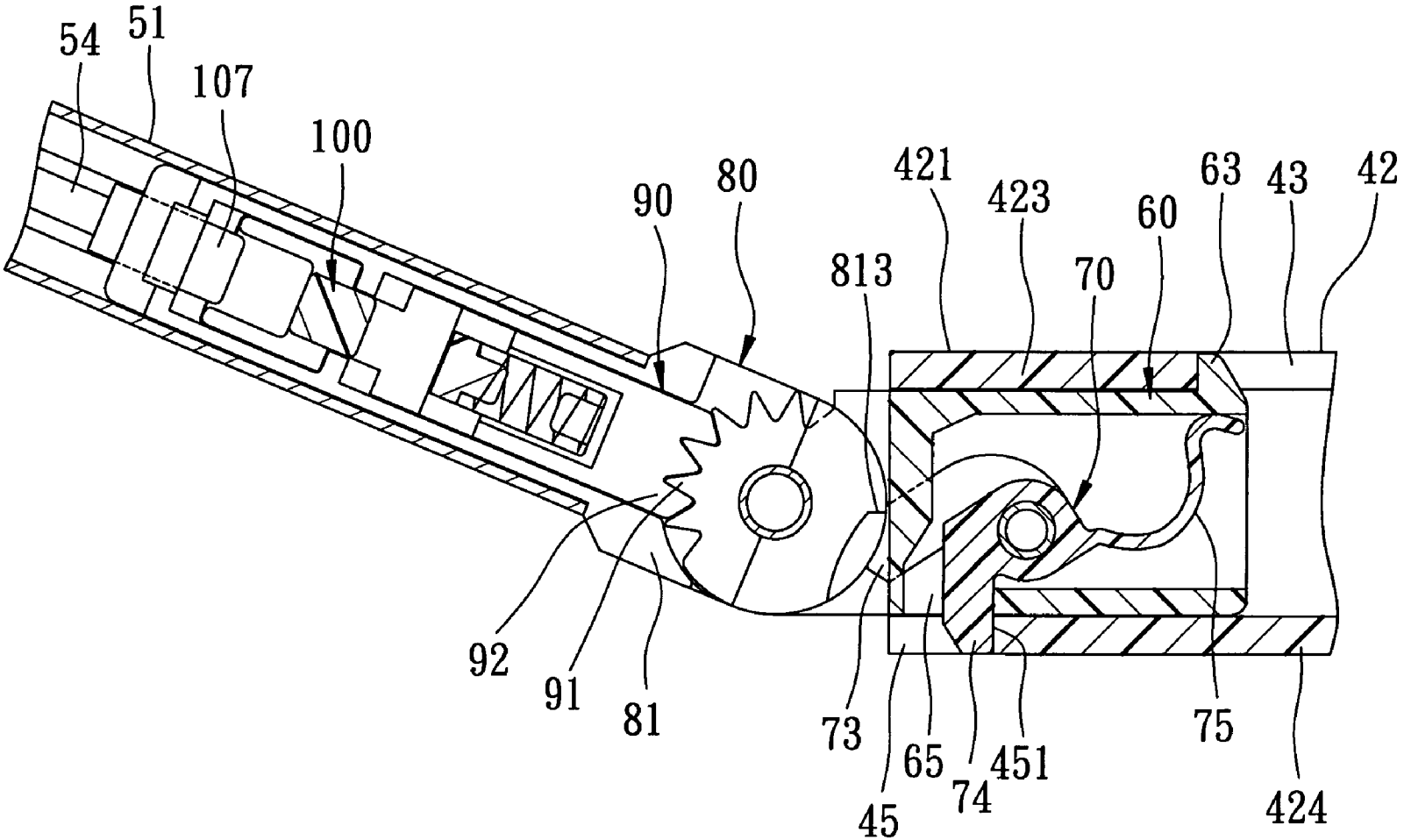
FIG. 10 is a fragmentary side sectional view to illustrate the preferred embodiment in a state where the slider is disposed at the second position, where the abutting member is disposed at a second angular position, and where the handle rod is disposed at an inclined position.

In this embodiment, the abutting members 70 are pivoted relative to the respective sliders 60 in a first direction from the first angular position to the second angular position when the handle rods 51 are pivoted relative to the respective sliders 60 in a second direction opposite to the first direction from the non-inclined position (see FIG. 9) to the inclined position (see FIG. 10).

Figure 6:
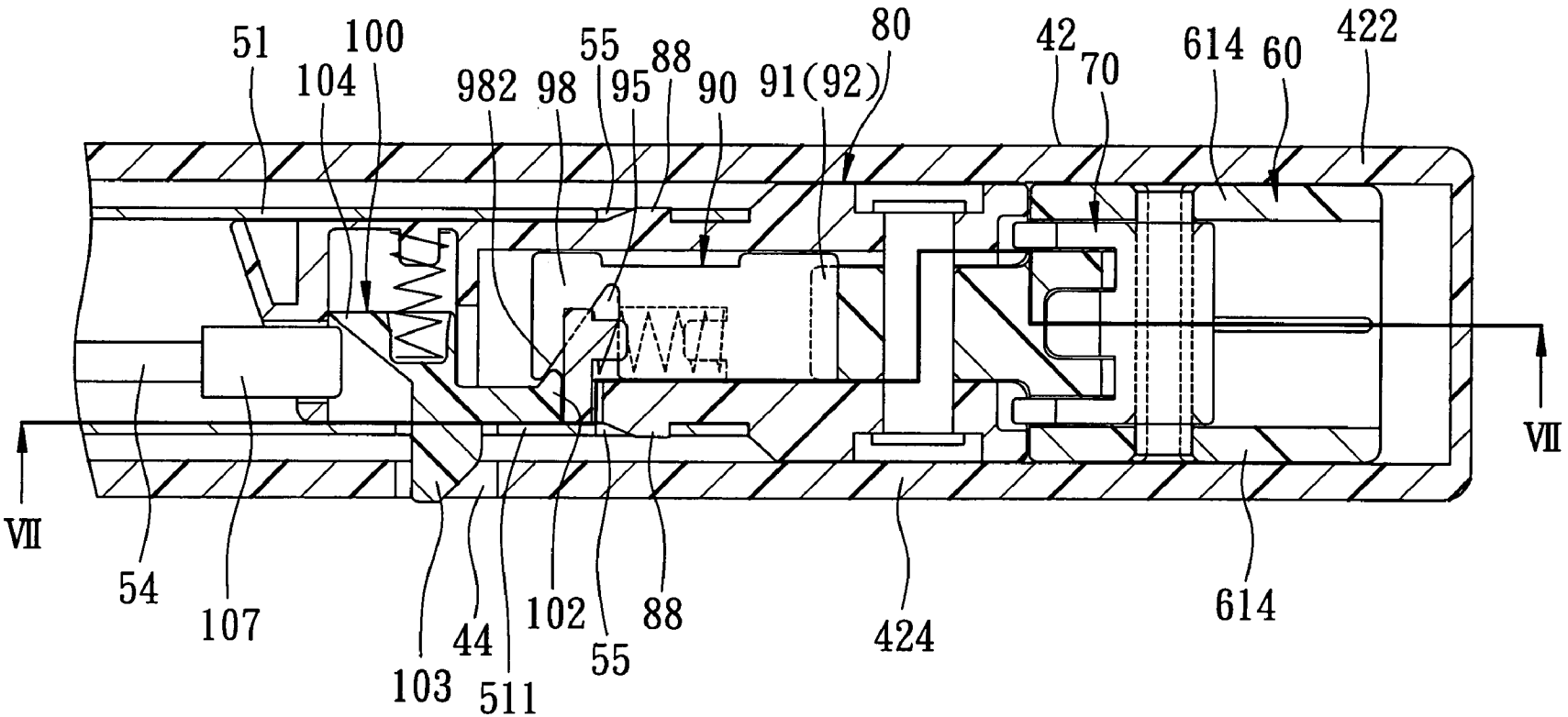
FIG. 6 is a fragmentary top sectional view to illustrate the preferred embodiment in a state where a slider is disposed at a first position, where an abutting member is disposed at a first angular position, where a handle rod is disposed at a non-inclined position relative to a guiding rail, and where first and second toothed parts engage each other.
Figure 7:
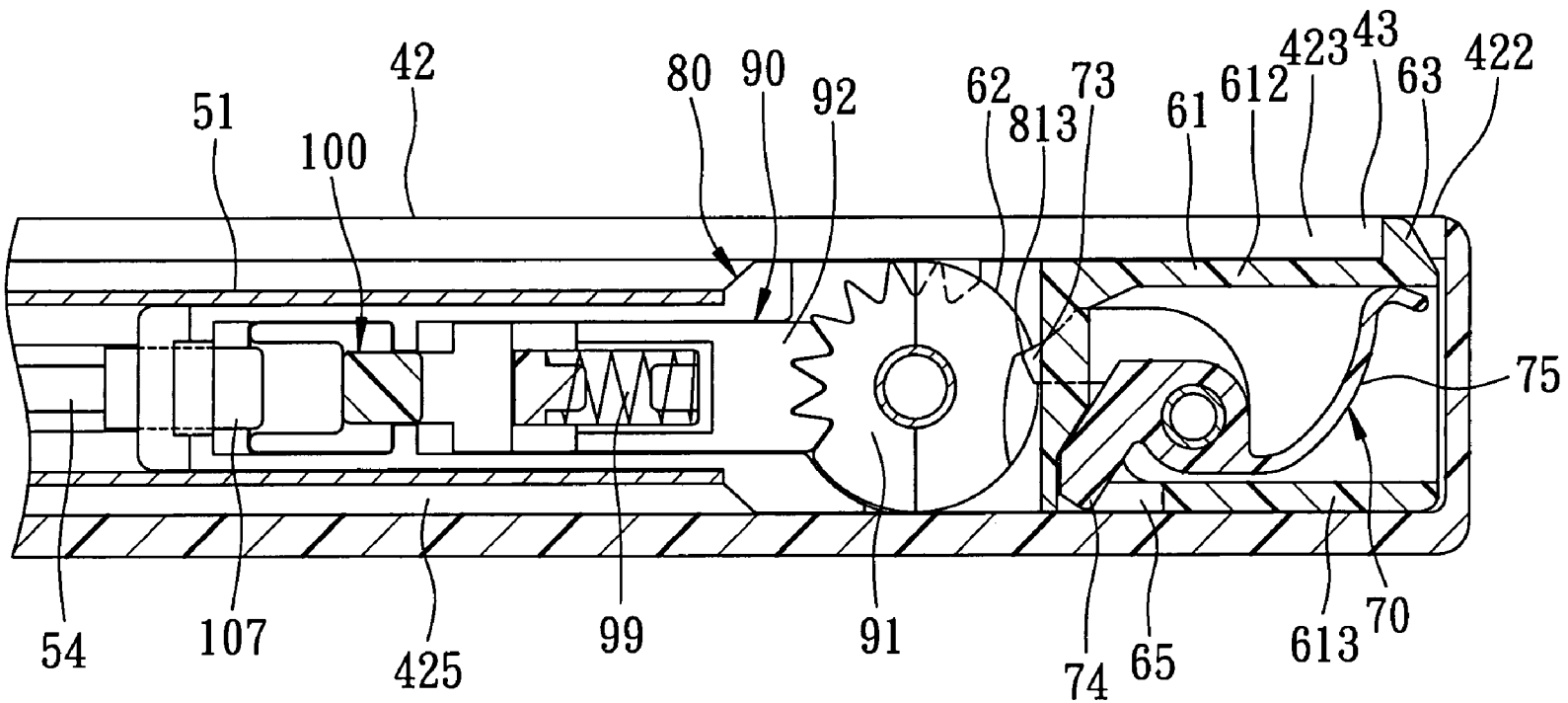
FIG. 7 is a fragmentary side sectional view to illustrate the preferred embodiment in the state shown FIG. 6.

Referring back to FIG. 4, in combination with FIGS. 6 and 7, each of the sliders 60 has a case part 61 that defines a chamber 610 therein and that has opposite top and bottom walls 612, 613 and two opposite side walls 614 extending between the top and bottom walls 612, 613. Each of the abutting members 70 is pivoted to the side walls 614 of the case part 61 of the respective slider 60. The bottom wall 613 of the case part 61 is formed with a bottom opening 65 for extension of the abutting protrusion 74 therethrough.

The case part 61 further has a front wall 611 that interconnects the side walls 614 of the case part 61 and that is formed with a pair of slots 64. Each of the abutting members 70 further has a pair of driven protrusions 73 protruding therefrom through the slots 64, respectively, in the front wall 611 toward a respective one of the coupling units 80. Each of the sliders 60 further has a pivot part 62 that protrudes frontwardly from the front wall 611 of the case part 61 toward the respective coupling unit 80. Each of the coupling units 80 includes a pivot joint 81 that is pivoted to the pivot part 62 of the respective slider 60 and that has a pair of driving protrusions 813 respectively in sliding contact with the driven protrusions 73 of the respective abutting member 70 so as to drive the abutting members 70 to pivot relative to the sliders 60 when the handle rods 51 are pivoted relative to the sliders 60, respectively.

Each of the guiding rails 42 is in the form of a rectangular tube, defines a channel 425 (se FIG. 5) therein, and further has a top wall 423 that is opposite to the bottom wall 424 of the guiding rail 42. Each of the sliders 60 is confined in the channel 425 in the respective guiding rail 42 and each of the handle rods 51 is fully retracted into the channel 425 in the respective guiding rail 42 when the sliders 60 are disposed at the first position. The top wall 423 of each of the guiding rails 42 is formed with an elongated opening 43 (see FIG. 7) that has a closed end 431 (see FIG. 9) disposed adjacent to the front end portion 421 of the guiding rail 42 and that is defined by an opening-defining wall which has a stopping face 432 at the closed end 431 of the opening 43. The top wall 612 of the case part 61 is formed with an elastic protrusion 63 that projects into the opening 43 (see FIGS. 7 and 9) in the top wall 423 of the respective guiding rail 42 and that abuts against the stopping face 432 of the opening-defining wall (see FIG. 9) such that at least a portion of the case part 61 remains in the channel 425 in the respective guiding rail 42 and that the handle rods 51 are fully extended from the guiding rails 42 when the sliders 60 are disposed at the second position. Note that the pivot part 62 of each of the sliders 60 is disposed outwardly of the channel 425 in the respective guiding rail 42 when the sliders 60 are disposed at the second position.

Each of the handle rods 51 is hollow. Each of the coupling units 80 further has a mounting seat 82 that extends frontwardly from the pivot joint 81 and into a respective one of the handle rods 51. Each of the retaining units 90 includes a first toothed part 91 that is formed on the pivot part 62 of a respective one of the sliders 60, and a second toothed part 92 that is mounted movably on the mounting seat 82 of a respective one of the coupling units 80 and that engages releasably the first toothed part 91 (see FIGS. 7, 9, 10, 11, and 12) so as to retain the handle rods 51 at the desired angle relative to the guiding rails 42 when the sliders 60 are disposed at the second position.

Each of the handle rods 51 has a rear end 511, and is formed with two opposite retaining holes 55 (see FIGS. 4 and 6) disposed adjacent to the rear end 511. The mounting seat 82 of each coupling unit 80 is formed with two opposite retaining protrusions 88 that extend respectively into the retaining holes 55 so as to be held to the respective handle rod 51.

Figure 8:
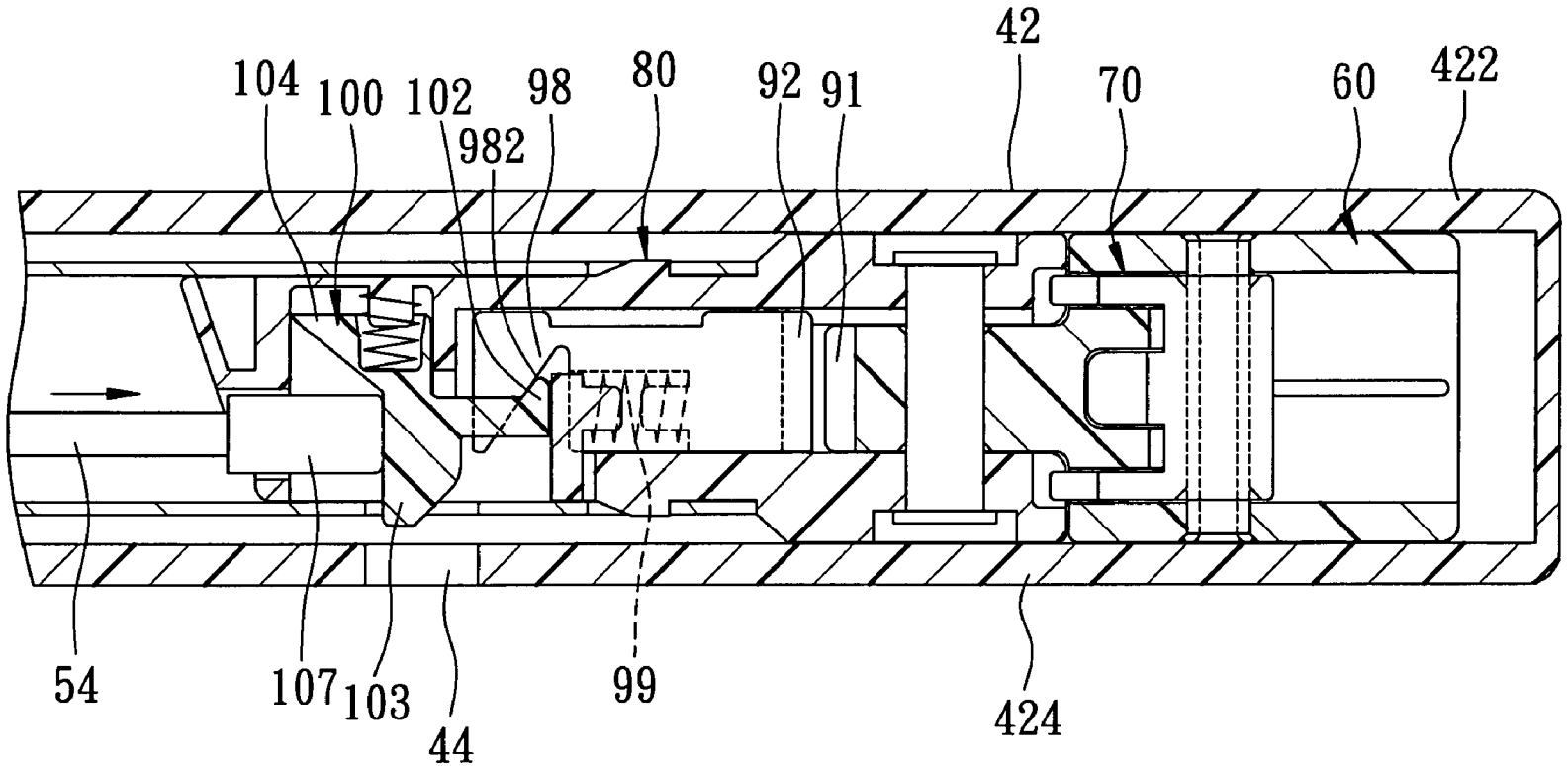
FIG. 8 is a fragmentary top sectional view to illustrate the preferred embodiment in a state where the slider is disposed at the first position, where the abutting member is disposed at the first angular position, where the handle rod is disposed at the non-inclined position, and where the first and second toothed parts are disengaged from each other.

The luggage further includes a pair of releasing units 100, each of which includes a main body 101 mounted movably on the mounting seat 82 of a respective one of the coupling units 80 and formed with a first cam 102. Each of the releasing units 100 further includes a first cam follower 98 extending frontwardly from the second toothed part 92, a first urging member 99 for urging the second toothed part 92 to move in a rearward direction toward the first toothed part 91, and a rod-shaped operating member 54 extending into a respective one of the handle rods 51 for moving the first cam 102 in a first transverse direction relative to the rearward direction. The first cam 102 engages slidably the first cam follower 98 in such a manner that movement of the first cam 102 in the first transverse direction results in movement of the second toothed part 92 in a frontward direction opposite to the rearward direction against urging action of the first urging member 99 so as to disengage the second toothed part 92 from the first toothed part 91 (see FIG. 8).

An operating button 53 is mounted on the grip part 56, which interconnects front ends of the handle rods 51, is connected to the operating members 54, and is pressable so as to actuate the operating members 54 to drive the first cam 102 to move in the first transverse direction.

Each of the releasing units 100 further includes a second cam 107 formed on a rear end of a respective one of the operating members 54, a second cam follower 104 extending from the main body 101, and a second urging member 106 for urging the second cam follower 104 together with the main body 101 and the first cam 102 in a second transverse direction opposite to the first transverse direction. The second cam 107 engages slidably the second cam follower 104 in such a manner that movement of the respective operating member 54 in the rearward direction results in movement of the second cam follower 104 and the first cam 102 in the first transverse direction against urging action of the second urging member 106.

Each of the abutting members 70 further has an elastic tail 75 that extends therefrom to abut elastically against the elastic protrusion 63 of the case part 61 of a respective one of the sliders 60 and that is elastically deformed (see FIG. 10) when the respective abutting member 70 is pivoted from the first angular position to the second angular position so as to accumulate a restoring force to restore the respective abutting member 70 from the second angular position to the first angular position when the handle rods 51 are pivoted from the inclined position to the non-inclined position.

Referring back to FIGS. 4 and 6, the first cam follower 98 includes two opposite side walls, each of which is formed with a V-shaped notch 95 and each of which defines a cam face 982. The first cam 102 protrudes from the main body 101 into the notches 95 in the side walls of the first cam follower 98, and is in sliding contact with the cam faces 982 of the first cam follower 98.

Figure 1:
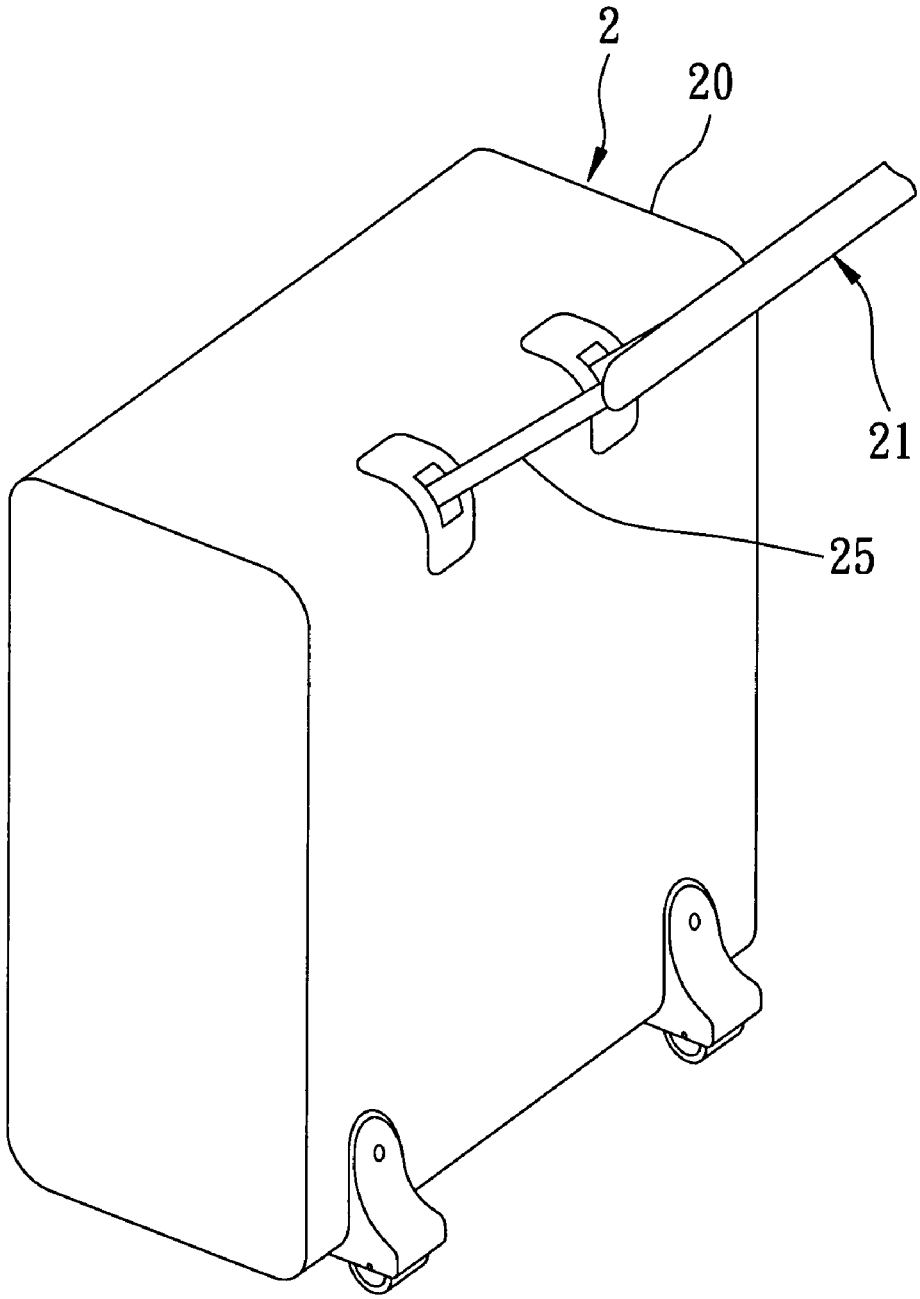
FIG. 1 PRIOR ART
FIG. 1 is a perspective view of a conventional luggage.
Figure 2:
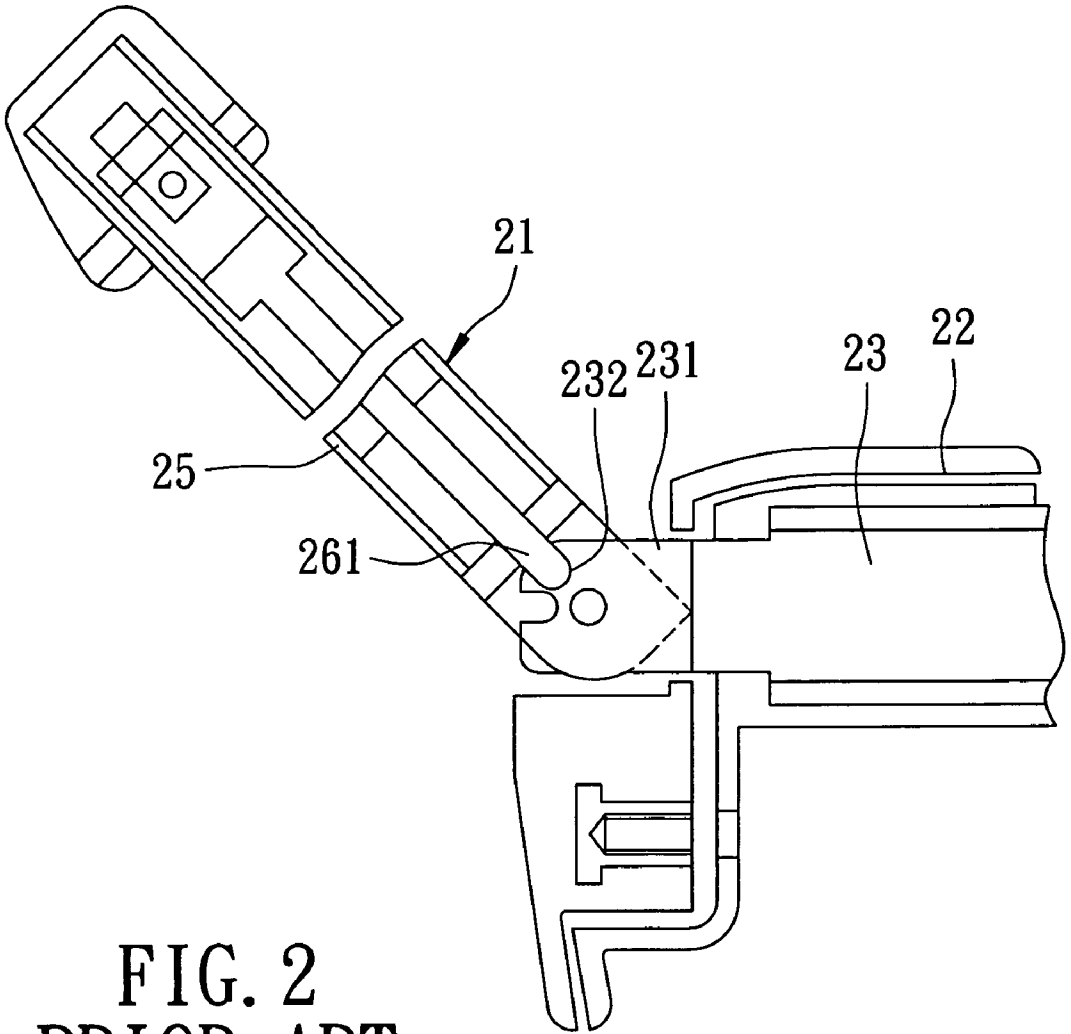
FIG. 2 PRIOR ART
FIG. 2 is a fragmentary schematic view of the conventional luggage.
Figure 3:
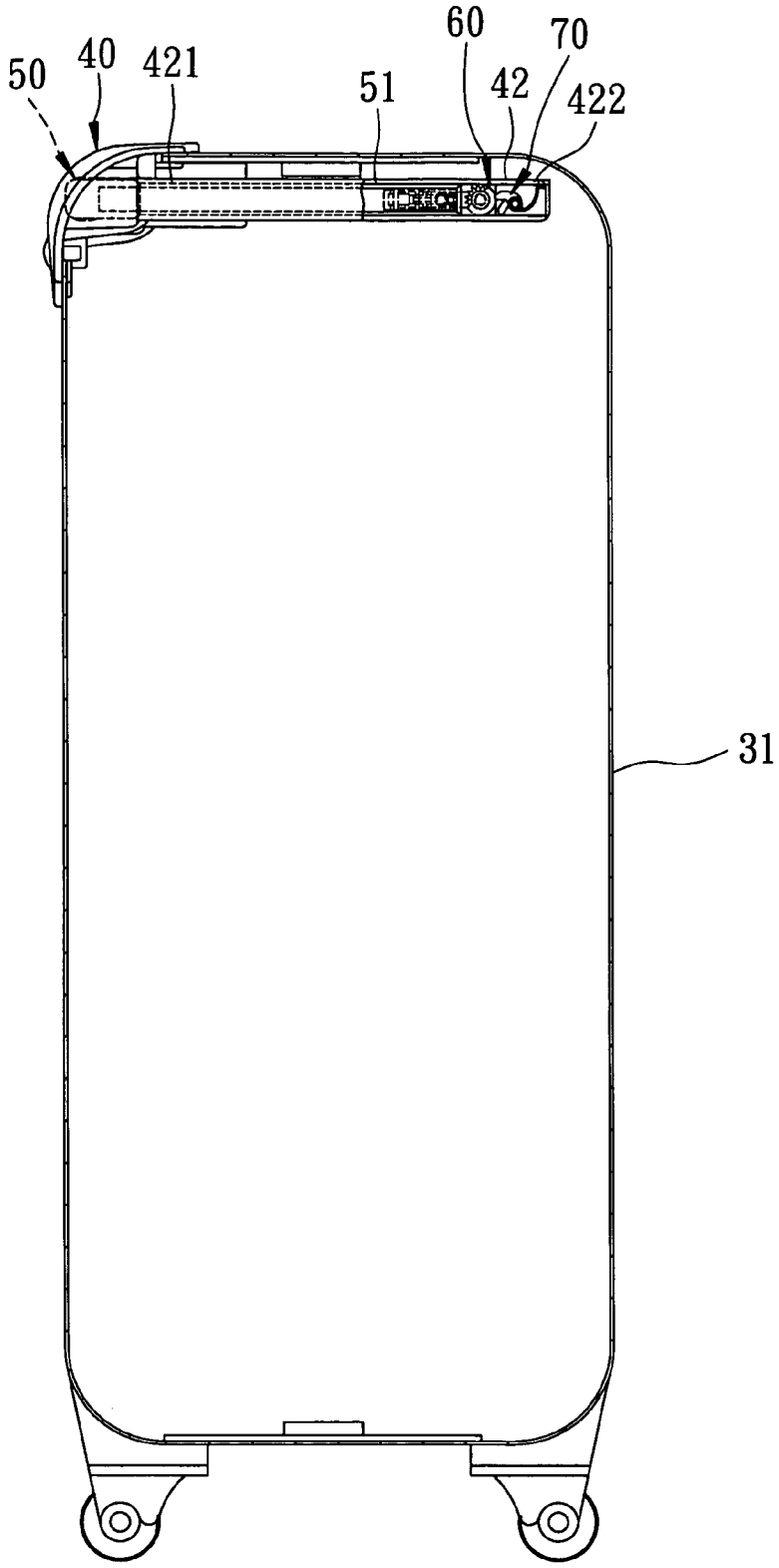
FIG. 3 is a side view of the preferred embodiment of a luggage according to this invention.
Figure 4:
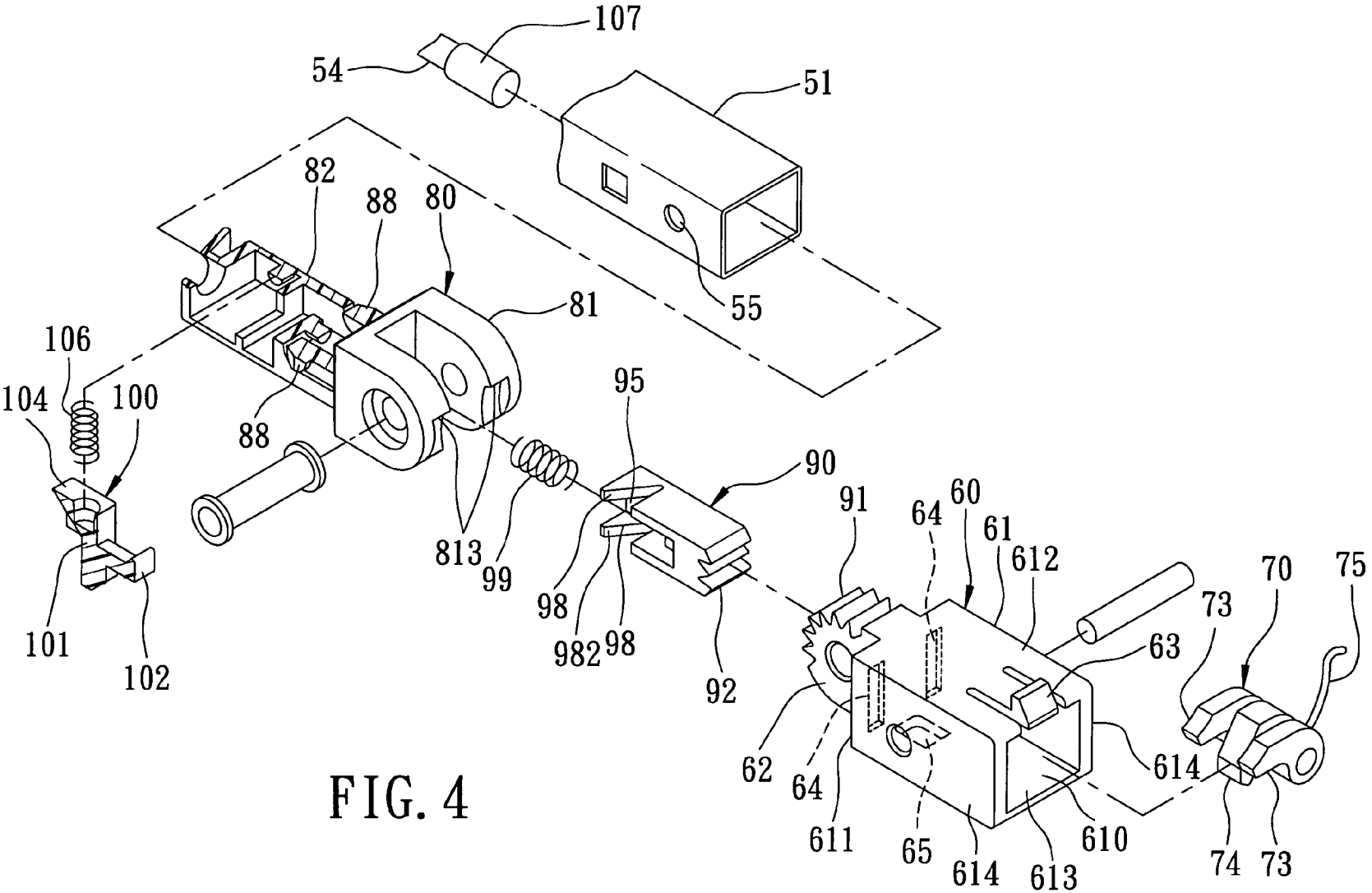
FIG. 4 is a fragmentary exploded perspective view of the preferred embodiment.
Figure 5:
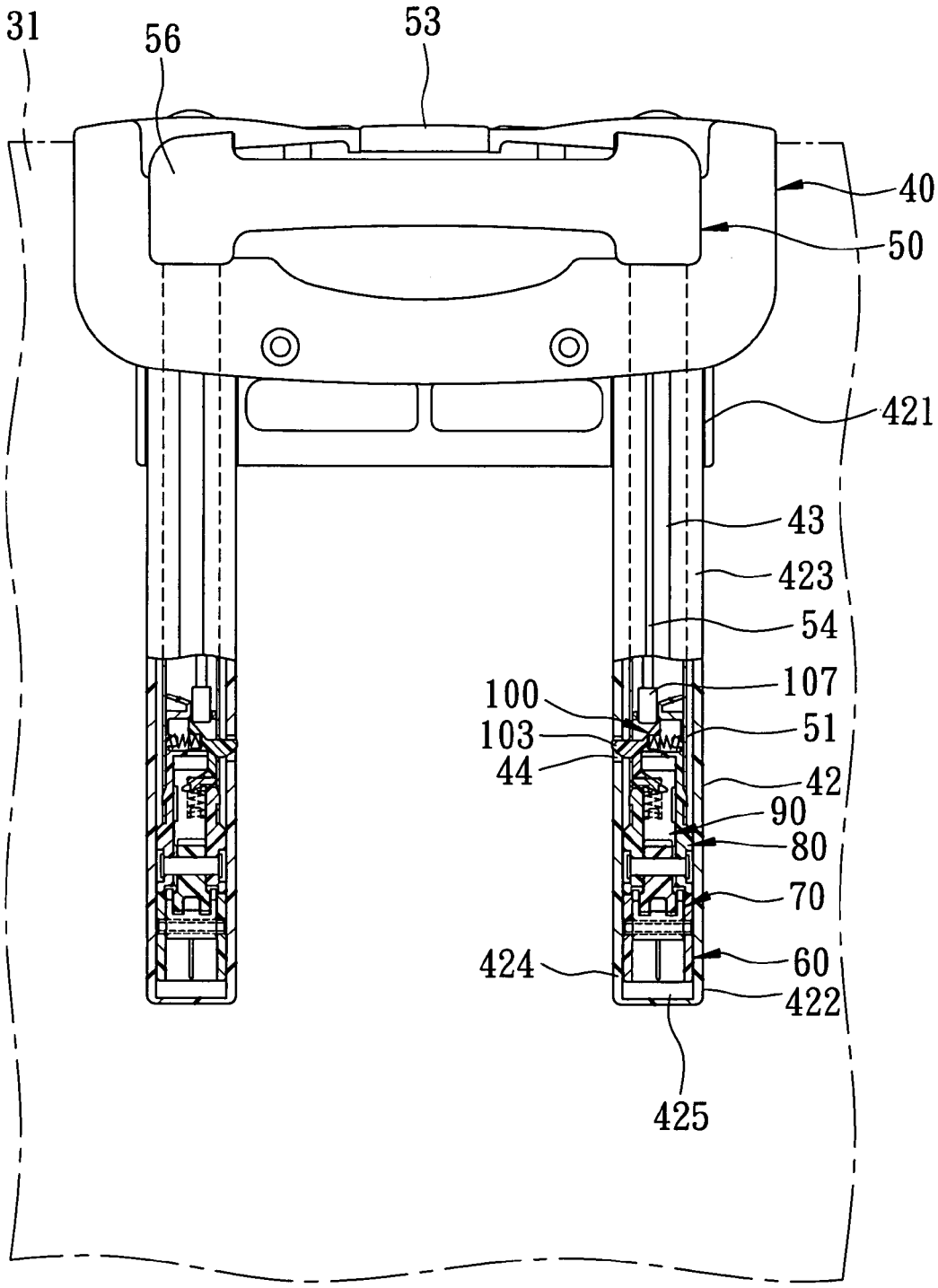
FIG. 5 is a fragmentary, partly cutaway, schematic top view of the preferred embodiment.

The bottom wall 424 of each of the guiding rails 42 is further formed with an aperture 44 (see FIGS. 5 and 6). The main body 101 of each of the releasing units 100 is further formed with a push protrusion 103 that protrudes therefrom through the respective handle tube 51 and into the aperture 44 in the bottom wall 424 of the respective guiding rail 42.

Figure 11:
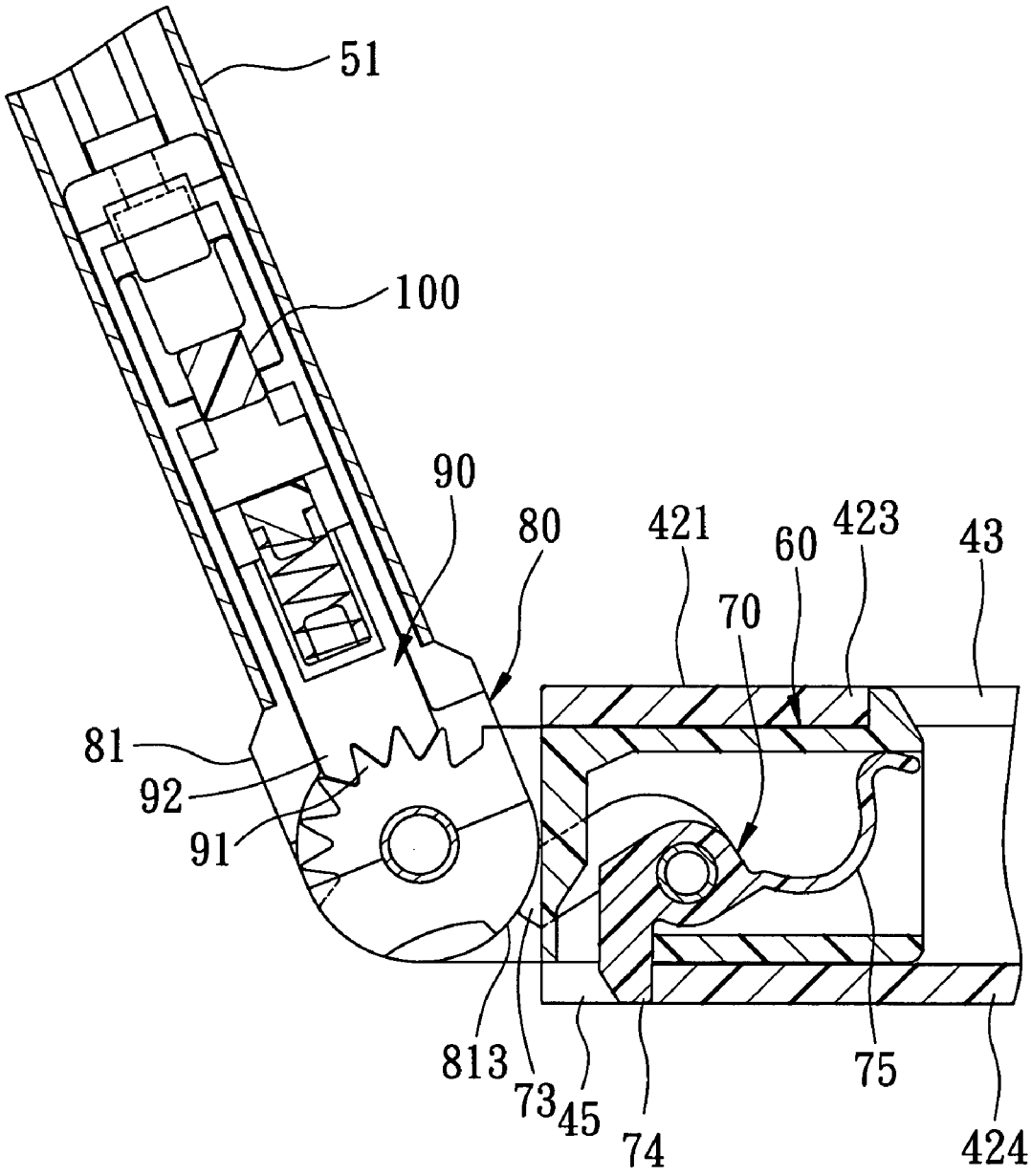
FIG. 11 is fragmentary side sectional view to illustrate the preferred embodiment in a state where the handle rod is disposed at an inclined angle different from that of the inclined position of the handle rod shown in FIG. 10.
Figure 12:
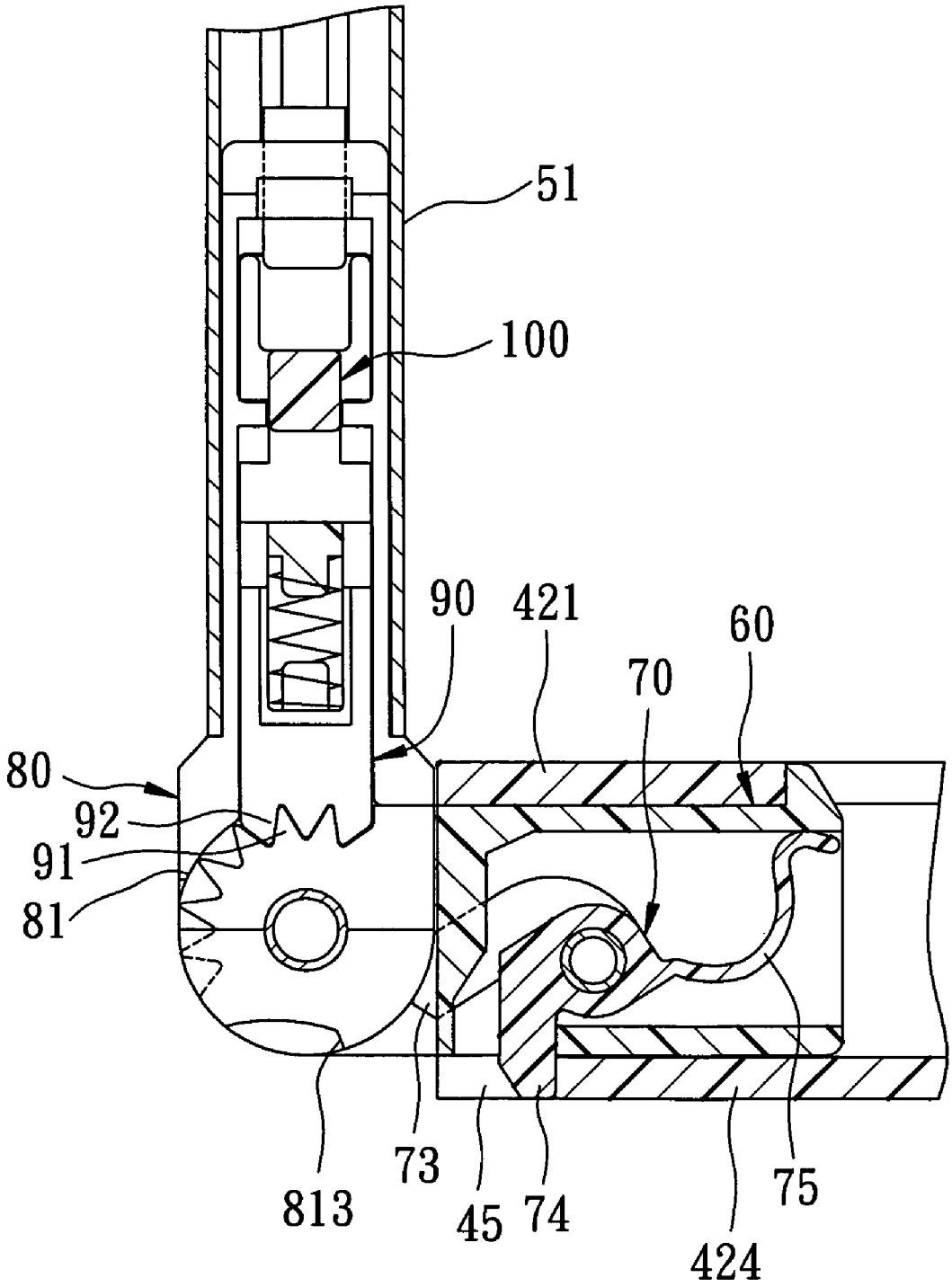
FIG. 12 is fragmentary side sectional side to illustrate the preferred embodiment in a state where the handle rod is disposed at a right angle relative to the guiding rail.
Figure 13:
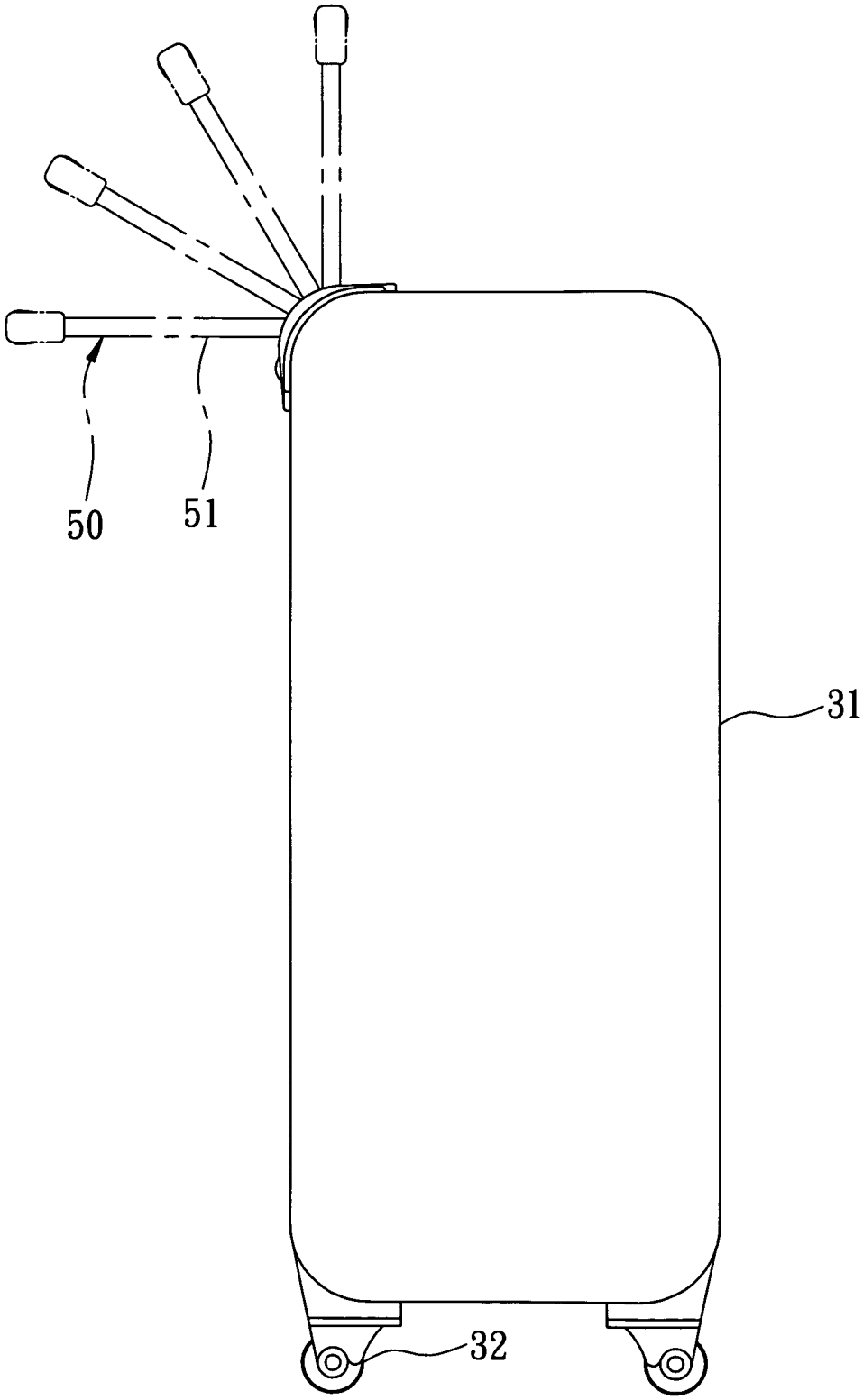
FIG. 13 is a schematic side view to illustrate different adjustable positions of the handle rod of the preferred embodiment.

The handle rods 51 can be further pivoted from the inclined angle relative to the guiding rails 42 shown in FIG. 10 to different angles as shown in FIGS. 11 to 13. The extent of position adjustment of the handle rods 51 relative to the guiding rails 42 through engagement and disengagement of the first and second toothed parts 91, 92 depends on the configuration (teeth number) of the first and second toothed parts 91, 92.

The case body 31 includes a top wall, a bottom wall opposite to the top wall and provided with wheels thereon, and lateral side walls extending between the top and bottom walls. In this preferred embodiment, the handle assembly is mounted on the top wall in such a manner that that handle rods 51 extend in a horizontal direction relative to the ground when the handle rods 51 is disposed at the non-inclined position. Alternatively, the handle assembly can be mounted on one of the side walls so that the handle rods 51 extend in a vertical direction relative to the ground when the handle rods 51 is disposed at the non-inclined position.

With the inclusion of the abutting members 70, which can be operated by the handle unit 50 and which functions to abut against the case body 31 when the luggage is moved in a pushing manner using the handle unit 50, in the luggage of this invention, the aforesaid drawbacks associated with the prior art can be eliminated.

With the invention thus explained, it is apparent that various modifications and variations can be made without departing from the spirit of the present invention. It is therefore intended that the invention be limited only as recited in the appended claims.

I claim:

1. A luggage comprising:

a case body;

a handle-storing unit including at least a guiding rail that is secured to said case body, and that has opposite front and rear end portions and a bottom wall which is formed with a through-hole defined by a hole-defining wall and disposed adjacent to said front end portion of said guiding rail, said hole-defining wall having an abutting face;

a slider mounted slidably on said guiding rail, and slidable on said guiding rail between a first position, in which said slider is disposed adjacent to said rear end portion of said guiding rail, and a second position, in which said slider is disposed adjacent to said front end portion of said guiding rail;

a coupling unit pivoted to said slider;

a handle unit including at least an elongated handle rod that is coupled to said slider through said coupling unit and that is pivotable relative to said slider when said slider is disposed at said second position;

an abutting member pivoted to said slider, having an abutting protrusion that protrudes therefrom, and driven by said handle rod through said coupling unit to pivot relative to said slider from a first angular position to a second angular position when said handle rod is pivoted relative to said slider from a non-inclined position to an inclined position relative to said guiding rail, said abutting protrusion being disposed outwardly of said through-hole when said abutting member is disposed at said first angular position and when said slider is disposed at said second position, and extending into said through-hole and being disposed frontwardly of and abutting against said abutting face of said hole-defining wall when said abutting member is disposed at said second angular position and when said slider is disposed at said second angular position; and a retaining unit for retaining said handle rod at a desired angle relative to said guiding rail when said slider is disposed at said second positions;

wherein said a butting member is pivoted relative to said slider in a first direction from said first angular position to said second angular position when said handle rod is pivoted relative to said slider in a second direction opposite to said first direction from said non-inclined position to said inclined position;

wherein said slider has a case part that defines a chamber therein and that has opposite top and bottom walls and two opposite side walls extending between said top and bottom walls, said abutting member being pivoted to said side walls, said bottom wall of said case part being formed with a bottom opening for extension of said abutting protrusion therethrough; and wherein said case part further has a front wall that interconnects said side walls of said case part and that is formed with a slot, said abutting member further having a driven protrusion that protrudes therefrom through said slot in said front wall toward said coupling unit, said slider further having a pivot part that protrudes frontwardly from said front wall toward said coupling unit, said coupling unit including a pivot joint that is pivoted to said pivot part and that has a driving protrusion in sliding contact with said driven protrusion so as to drive said abutting member to pivot relative to said slider when said handle rod is pivoted relative to said slider.

2. The luggage of claim 1, wherein said guiding rail is in the form of a rectangular tube and further has a top wall that is opposite to said bottom wall of said guiding rail, said guiding rail defining a channel therein, said slider being confined in said channel and said handle rod being fully retracted into said channel when said slider is disposed at said first position, said top wall of said guiding rail being formed with an elongated opening that has a closed end disposed adjacent to said front end portion of said guiding rail and that is defined by an opening-defining wall which has a stopping face at said closed end of said opening, said top wall of said case part being formed with an elastic protrusion that projects into said opening and that abuts against said stopping face of said opening-defining wall such that at least a portion of said case part remains in said channel and that said handle rod is fully extended from said guiding rail when said slider is disposed at said second position, said pivot part being disposed outwardly of said channel when said slider is disposed at said second position.

3. The luggage of claim 2, wherein said handle rod is hollow, said coupling unit further having a mounting seat that extends frontwardly from said pivot joint and into said handle rod, said retaining unit including a first toothed part that is formed on said pivot part of said slider, and a second toothed part that is mounted movably on said mounting seat of said coupling unit and that engages releasably said first toothed part so as to retain said handle rod at the desired angle relative to said guiding rail when said slider is disposed at said second position.

4. The luggage of claim 3, wherein said handle rod has a rear end and is formed with two opposite retaining holes disposed adjacent to said rear end, said mounting seat being formed with two opposite retaining protrusions that extend respectively into said retaining holes so as to be held to said handle rod.

5. The luggage of claim 4, further comprising a releasing unit that includes a first cam mounted movably on said mounting seat, a first cam follower extending frontwardly from said second toothed part, a first urging member for urging said second toothed part to move in a rearward direction toward said first toothed part, and an operating member extending into said handle rod for moving said first cam in a first transverse direction relative to said rearward direction, said first cam engaging slidably said first cam follower in such a manner that movement of said first cam in said first transverse direction results in movement of said second toothed part in a frontward direction opposite to said rearward direction against urging action of said first urging member so as to disengage said second toothed part from said first toothed part.

6. The luggage of claim 5, wherein said releasing unit further includes a second cam formed on said operating member, a second cam follower connected to said first cam, and a second urging member for urging said second cam follower and said first cam in a second transverse direction opposite to said first transverse direction, said second cam engaging slidably said second cam follower in such a manner that movement of said operating member in said rearward direction results in movement of said second cam follower and said first cam in said first transverse direction against urging action of said second urging member.

7. The luggage of claim 2, wherein said butting member further has an elastic tail that extends therefrom to abut elastically against said elastic protrusion and that is elastically deformed when said abutting member is pivoted from said first angular position to said second angular position so as to accumulate a restoring force to restore said abutting member from said second angular position to said first angular position when said handle rod is pivoted from said inclined position to said non-inclined position.

8. A handle assembly for a luggage, comprising:

a handle-storing unit including at least a guiding rail that has opposite front and rear end portions and a bottom wall which is formed with a through-hole defined by a hole-defining wall and disposed adjacent to said front end portion of said guiding rail, said hole-defining wall having an abutting face;

a slider mounted slidably on said guiding rail, and slidable on said guiding rail between a first position, in which said slider is disposed adjacent to said rear end portion of said guiding rail, and a second position, in which said slider is disposed adjacent to said front end portion of said guiding rail;

a coupling unit pivoted to said slider;

a handle unit including at least an elongated handle rod that is coupled to said slider through said coupling unit and that is pivotable relative to said slider when said slider is disposed at said second position;

an abutting member pivoted to said slider, having an abutting protrusion that protrudes therefrom, and driven by said handle rod through said coupling unit to pivot relative to said slider from a first angular position to a second angular position when said handle rod is pivoted relative to said slider from a non-inclined position to an inclined position relative to said guiding rail, said abutting protrusion being disposed outwardly of said through-hole when said abutting member is disposed at said first angular position and when said slider is disposed at said second position, and extending into said through-hole and being disposed frontwardly of and abutting against said abutting face of said hole-defining wall when said abutting member is disposed at said second angular position and when said slider is disposed at said second position; and a retaining unit for retaining said handle rod at a desired angle relative to said guiding rail when said slider is disposed at said second position.

* * * * *